US009192980B2

(12) United States Patent
Hettich

(10) Patent No.: US 9,192,980 B2
(45) Date of Patent: Nov. 24, 2015

(54) METHOD AND ROLLING DIE FOR MANUFACTURING A SCREW

(75) Inventor: Ulrich Hettich, Schramberg (DE)

(73) Assignee: Ludwig Hettich & Co., Schramberg-Sulgen (DE)

( * ) Notice: Subject to any disclaimer, the term of this patent is extended or adjusted under 35 U.S.C. 154(b) by 537 days.

(21) Appl. No.: 13/548,763

(22) Filed: Jul. 13, 2012

(65) Prior Publication Data

US 2012/0316000 A1 Dec. 13, 2012

(51) Int. Cl.
*B21H 3/06* (2006.01)
*B21H 3/02* (2006.01)

(52) U.S. Cl.
CPC ... *B21H 3/06* (2013.01); *B21H 3/02* (2013.01)

(58) Field of Classification Search
CPC ..... B21H 3/00; B21H 3/02; B21H 3/022; B21H 3/025; B21H 3/027; B21H 3/06; B21H 3/065
USPC ..... 470/8, 9, 10, 58, 59, 185; 72/88, 90, 72/469
See application file for complete search history.

(56) References Cited

U.S. PATENT DOCUMENTS 3,854,350 A * 12/1974 Bauer et al. ..... 76/107.1

FOREIGN PATENT DOCUMENTS

| | | | |
|---|---|---|---|
| DE | 57269 | | 6/1891 |
| DE | 2241293 | A1 | 9/1973 |
| DE | 602004004057 | T2 | 7/2007 |
| EP | 1208927 | A2 | 5/2002 |
| FR | 2941507 | A1 | 1/2009 |
| JP | 48-038066 | B | 11/1973 |
| WO | 2009015754 | | 5/2009 |

OTHER PUBLICATIONS

International Searching Authority, English translation of the International Preliminary Report on Patentability PCT/EP2011/000155, Aug. 16, 2012, 7pgs.

* cited by examiner

*Primary Examiner* — Debra Sullivan
(74) *Attorney, Agent, or Firm* — Duane Morris LLP

(57) ABSTRACT

A method for manufacturing a screw is disclosed where a blank is rolled between two rolling dies. In each rolling die a rolling profile has been formed that comprises a host of elongated depressions. The rolling die has a first and a second end which are spaced apart from each other in the direction of rolling. During rolling, the blank is moved relative to the die from the first end in the direction of the second end. The mean pitch of the center lines of the depressions, which pitch is defined as the quotient of the changes in the positions of the center line in the direction across or parallel to the direction of rolling, in a region of the first end of the rolling die differs from the mean pitch in a region of the second end of the rolling die.

39 Claims, 6 Drawing Sheets

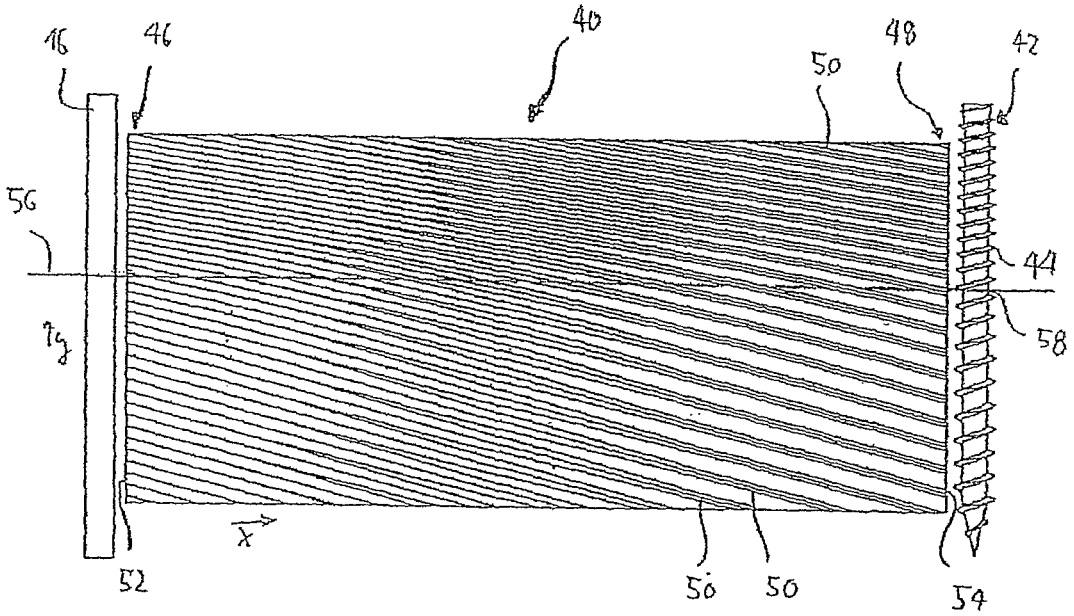
Fig. 3A
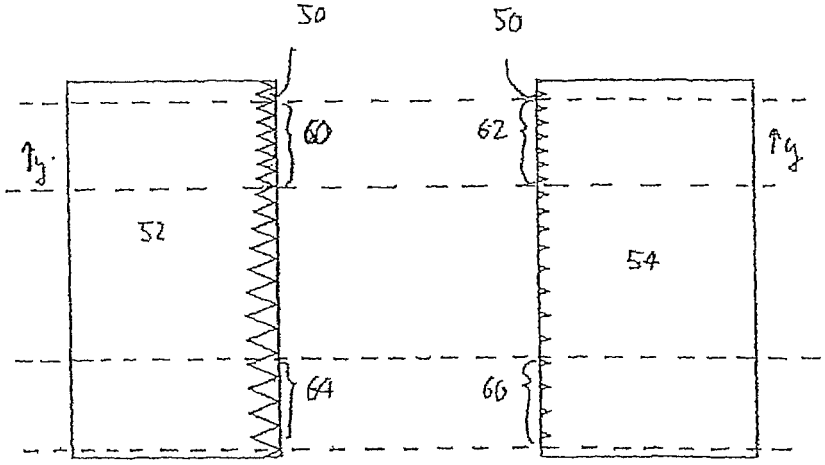
Fig. 3B
Fig. 3C

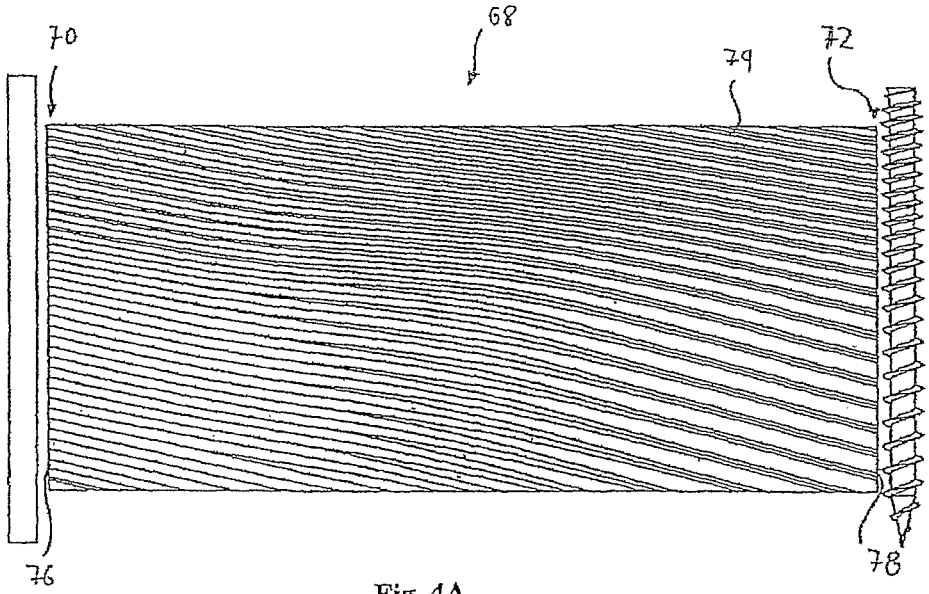
Fig. 4A
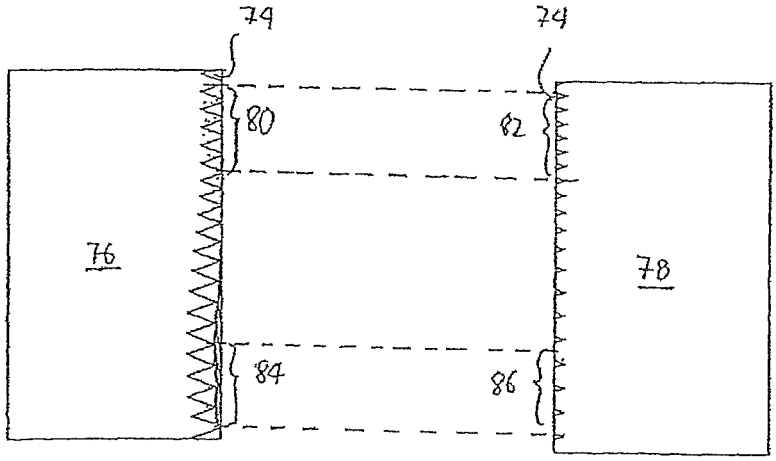
Fig. 4B
Fig. 4C

METHOD AND ROLLING DIE FOR MANUFACTURING A SCREW

BACKGROUND TO THE INVENTION

The present invention relates to a method for manufacturing a screw and to a rolling die. In a known method for manufacturing a screw a blank is rolled between two rolling dies for the purpose of forming the screw thread. In this arrangement there is a rolling profile in each rolling die, which rolling profile comprises a host of elongated depressions intended for forming the thread convolutions. Each rolling die comprises a first end and a second end spaced apart from each other in the direction of rolling, wherein a blank during rolling is moved relative to the rolling die from the first end towards the second end.

Conventionally, blanks are used that comprise at least one cylindrical portion that is formed to become the thread. Since during the rolling process as a result of transverse pressure a flow in longitudinal direction of the thread occurs, it is common practice to select the rolling diameter $d_{w0}$, i.e. the diameter of the blank used, in such a manner that the volume per unit of length in the blank is somewhat greater or equal to that of the finished thread. Thus the following applies to the rolling diameter $d_{w0}$:

$$d_{w0}=d_{G0}+d_{dV},$$

wherein $d_{G0}$ denotes a "cylindrical substitute diameter" of the finish-rolled thread, namely the diameter of an imaginary substitute cylinder whose volume per unit of length corresponds to that of the finish-rolled thread. $d_{dV}$ is an addition to the rolling diameter, which addition is intended to compensate for the axial thrust; typically it is less than 5% of $d_{w0}$.

If a screw with a desired thread form is to be manufactured in the rolling process, $d_{G0}$ is determined by this thread form, and $d_{dV}$ results automatically in the rolling process. This means that in order to manufacture a particular thread form in the rolling process, a very specific rolling diameter $d_{w0}$ needs to be selected; in other words there is no degree of freedom in terms of the selection of the diameter $d_{w0}$ of the section of the blank on which the thread is to be formed.

In general, an effort will be made to use a simple cylindrical blank because it can be manufactured most simply and cost-effectively; in the present case the diameter of the blank is determined by $d_{w0}$. However, in practical application this often leads to problems. For example, if a screw head is to be manufactured by pressing a corresponding thread-free section of the blank, the predetermined diameter $d_{w0}$ is often simply too small for this. In this case it is unavoidable to use a blank with a variable diameter, with a first, slimmer, section for forming the thread, and a second, thicker, section for forming the head. A similar situation occurs in the manufacture of hanger screws, i.e. screws that comprise two different threads that are separate from each other, typically a metric thread and a self-tapping wood-screw thread. For both threads an associated required rolling diameter $d_{w0}^{(1)}$ or $d_{w0}^{(2)}$ results, which diameters, as a rule, will, however, not be identical. In this case, too, it is unavoidable to provide a blank with two sections of different diameters, which leads, however, to a significant increase in the cost of manufacture.

SUMMARY OF THE INVENTION

It is the object of the invention to provide a method of the type mentioned above, in which the above problems are avoided.

This object is met by means of the method according to claim 1. In this method a special rolling die according to claim 19 is used. Advantageous embodiments are defined in the dependent claims. According to the method of the invention a rolling die is used in which the mean slope of the centre lines of the depressions, which slope is defined as the quotient of the changes in the positions of the centre line in the directions transverse and parallel to the direction of rolling, respectively, in a first region of the first end of the rolling die differs from the mean slope in a region of the second end of the rolling die which—when viewed in the direction of rolling—is opposite said region of the first end.

Such a rolling die significantly differs from a conventional rolling die in which the centre lines of all the depressions are straight, parallel and equidistant from each other. This means that in a conventional rolling die, the slope of the centre lines of the depressions anywhere on the rolling die, and in particular at its first end and second end, is identical. Contrary to this, according to the invention it is proposed that the slope of the depressions along the direction of rolling be varied in such a manner that the mean slope in—when viewed in the direction of rolling—opposite regions at the first end and at the second end of the rolling die differs. In this document, the term "opposite regions when viewed in the direction of rolling" refers to regions at the first and second ends of the rolling die, respectively, which are delimited by two lines that are parallel to the direction of rolling.

The variation in the slope of the depression in the direction of rolling is associated with a volume transport of the blank material in the axial direction, with the extent of said volume transport depending on the variation in the slope of the (centre lines of the) depressions. This means that the rigid correlation between the effective diameter $d_{G0}$ of the finished thread, which is determined by the screw design, and the rolling diameter $d_{w0}$ no longer exists. Instead, it is possible to freely select a blank diameter $d'_{w0}$ within certain limits, and in turn to suitably vary the slope of the depressions along the direction of rolling. The relationship between $d_{w0}$, $d'_{w0}$, the slope $P_1$ of the depressions at the first end, and the slope $P_2$ of the depression at the second end of the rolling die results from the conservation of volume as follows:

$$d_{w0}^2 \cdot P_2 = d'^2_{w0} \cdot P_1.$$

It should be noted that $P_2$, i.e. the slope of the depressions at the second end of the rolling die, is determined by the thread pitch of the finished screw, because the rolling process ends at the second end of the rolling die. Furthermore, as described in the introduction, $d_{w0}$ is determined by the desired thread shape, the cylindrical substitute diameter $d_{G0}$ and the addition $d_{dV}$. However, within certain limits, a desired modified rolling diameter $d'_{w0}$ can be selected. To this effect, according to the above equation only the slope $P_1$ of the depressions at the first end of the rolling die needs to be selected as follows:

$$P_1 = \frac{d_{w0}^2}{d_{w0}'^2} \cdot P_2.$$

This consideration was based on the assumption that the slope $P_1$ is identical for all the depressions at the first end of the rolling die, and that the slope $P_2$ is identical for all the depressions at the second end of the rolling die. However, the invention is by no means limited to this embodiment; instead, this disclosure also describes embodiments for variable pitch screws, for the manufacture of which screws a rolling die is used in which the slopes of the depressions vary among each other, both at the first end and at the second end. In order to take into account both cases, hereinafter reference is made to the "mean slope" in certain regions.

Preferably, the mean slope $P_2$ in the region of the second end is greater than the mean slope $P_1$ in the opposite region of the first end, i.e. $P_2>P_1$. Graphically speaking, this corresponds to an elongation of the blank during rolling, and in view of the above equation means that $d'_{w0}>d_{w0}$. Accordingly, in order to manufacture a particular screw shape, a blank with a larger rolling diameter $d'_{w0}$ can be used than in a rolling method according to the state of the art, in which the rolling diameter of the blank would be determined to be $d_{w0}$. For example, the rolling diameter $d'_{w0}$ can be selected so that it makes it possible for a screw head to be formed by pressing.

Preferably, the above-mentioned mean slope in the above-mentioned regions at the first end and at the second end differ from each other by at least 2.5%, preferably at least 10% and particularly preferably by at least 25%.

Preferably, the rolling profile is designed so that the mean volume per unit length of the finish-rolled screw thread is smaller by at least 5%, preferably at least 17% and particularly preferably at least 27% than that of the blank.

An important application of the method consists of uniformly stretching the blank during the rolling process. This means that from a cylindrical blank a thread is rolled whose volume per unit of length is constant in longitudinal direction of the thread. In other embodiments it can, however, be advantageous if the rolling profile is designed in such a manner that, starting with a cylindrical blank, a thread section is rolled in which the volume per unit of length varies. This is, for example, the case when a screw with a continuous thread and a variable thread pitch is to be manufactured in a rolling method. In this document the term "continuous thread" denotes a single continuous thread in contrast to two separate threads formed on the same screw.

A screw with a continuous thread with a variable thread pitch is, for example, described in WO 2009/015754. By means of a suitable variation in the thread pitch, residual stress can be generated in the bond between the screw and a component when the screw is driven into the component. According to the teaching of the above-mentioned patent specification, the variation in the thread pitch is to be selected such that the residual stress acts against a bond stress that occurs when the component is subjected to loads, so that at least the stress peaks of the resulting bond stress are reduced when the component is subjected to loads. Such a screw with a variable thread pitch can, for example, be used for reinforcing components, e.g. boardwork bearers, or for introducing forces into a component.

It is noted that in a region with a small thread pitch, i.e. with a lower lead, a screw with a variable thread pitch requires more material per unit of length in order to form the thread than is the case in a region with a large lead. If this additionally required material is not available during rolling, it can happen that the thread diameter in the region of a small thread pitch decreases, in other words that the thread is not being fully "filled" in the rolling process. Hereinafter, the local lack of material is also referred to as a "volume defect".

In the context of the invention it is possible to compensate for this volume defect by methodical variation of the slopes of the depressions of the rolling die and by a resulting material transport in the axial direction. To this effect, according to an embodiment of the invention, the rolling profile is thus selected so that the following inequation applies:

$$\frac{P_{21}}{P_{11}} < \frac{P_{22}}{P_{12}},$$

wherein $P_{21}$ denotes the mean slope of the (centre line of the) depressions in a first region at the second end of the rolling die, which slope is smaller than the mean slope $P_{22}$ of the depressions in a second region at the second end of the rolling die, and wherein $P_{11}$ and $P_{12}$ denote the mean slope in those regions at the first end of the rolling die, which—when viewed in the direction of rolling—are opposite the first and second regions of the second end, respectively.

In addition or as an alternative, a volume defect can also be compensated for in that for the finish-rolled thread in a region of a smaller thread pitch a smaller cross-sectional area of a thread ridge is selected by varying the flank angle and/or the thread depth. Thus in the region of a smaller thread pitch the thread can have a more acute flank angle than in a region of a larger thread pitch. In this manner a constant thread diameter can be maintained with less available material.

Preferably, in the rolling die those depressions whose centre lines in the region of the first end of the rolling die have a larger slope are deeper in the region of the first end of the rolling die than those depressions whose centre lines in the region of the first end of the rolling die have a smaller slope. Since depressions with a larger slope in the region of the first end are spaced further apart from each other, it is advantageous for the rolling process if these depressions are deeper. Preferably, the depressions in the region of the first end of the rolling die are V-shaped in cross section and their depth is proportional, at least within ±10%, to the slope of the centre line at the first end of the rolling die.

BRIEF DESCRIPTION OF THE FIGURES

Further advantages and characteristics of the invention are set out in the following description, in which the invention is described with reference to two exemplary embodiments with reference to the enclosed drawings. Therein.

FIG. 3A shows a top view of a rolling die for manufacturing a screw with a variable thread pitch without axial volume transport;

FIG. 3B shows a top view of an end face of the rolling die of FIG. 3A at its first end;

FIG. 3C shows a top view of an end face of the rolling die of FIG. 3A at its second end;

FIG. 4A shows a top view of a rolling die according to a second embodiment of the invention and of a blank and of a finish-rolled thread;

FIG. 4B shows a top view of an end face of the rolling die of FIG. 4A at its first end;

FIG. 4C shows a top view of an end face of the rolling die of FIG. 4A at its second end.

DESCRIPTION OF PREFERRED EMBODIMENTS

Figure 1A:
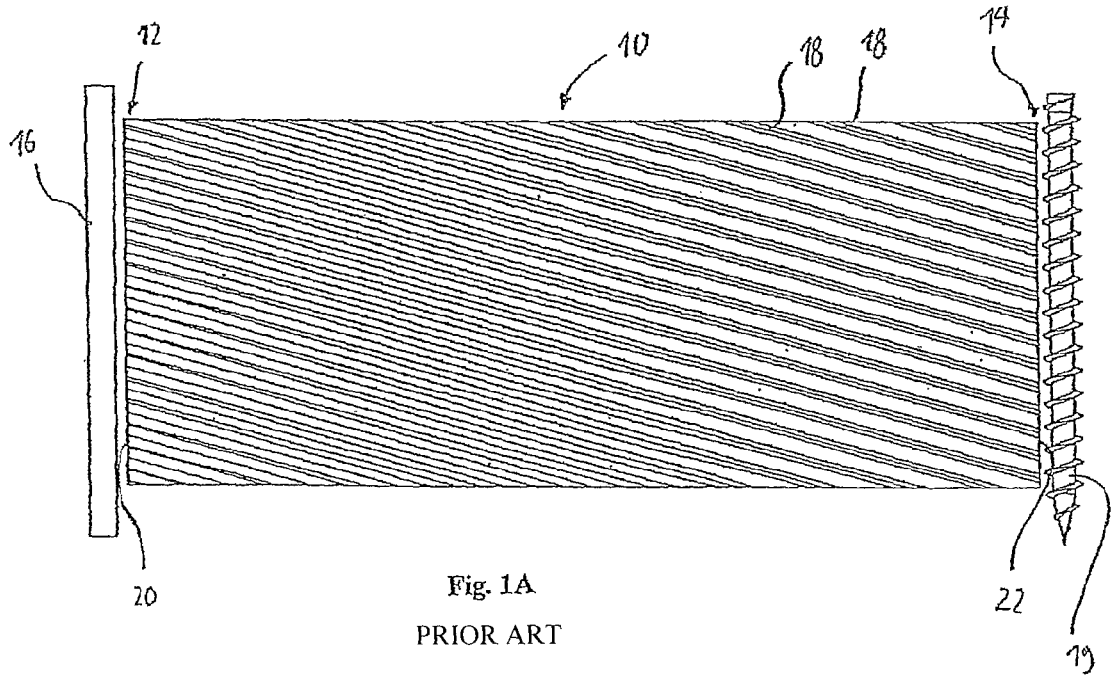
Fig. 1A PRIOR ART
FIG. 1A shows a top view of a rolling die according to the state of the art for rolling a thread with a constant thread pitch, and of a blank and of a finish-rolled thread.

FIG. 1A shows a top view of a rolling die 10 according to the prior art, by means of which rolling die 10 a screw with a constant thread pitch can be rolled.

Figure 1B:
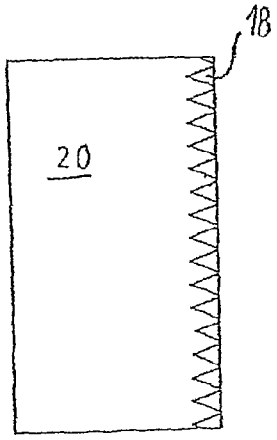
Fig. 1B PRIOR ART
FIG. 1B shows a top view of an end face of the rolling die of FIG. 1A at its first end.
Figure 1C:
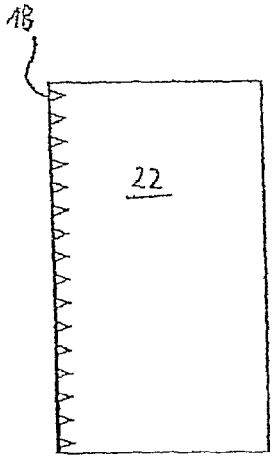
Fig. 1C PRIOR ART
FIG. 1C shows a top view of an end face of the rolling die of FIG. 1A at its second end.

The rolling die 10 comprises a first end 12 and a second end 14. During the rolling process a blank 16 is rolled from the first end 12 of the rolling die 10 towards the second end 14. The surface of the rolling die 10 comprises a rolling profile that is formed from a multitude of straight, parallel and equidistant depressions 18. The depressions 18 in the region of the first and second ends 12, 14 are shown in FIGS. 1B and 1C, respectively, which in each case show a top view of one of the end faces 20, 22 of the rolling die 10. A screw 19 with a finish-rolled thread is shown in the region of the second end 14 of the rolling die 10.

As shown in FIGS. 1A, 1B and 1C, the cross section of the depressions 18 changes between the first and the second end 12, 14 of the rolling die 10. However, the cross sections of all the depressions 18 at the first end 12 are identical (see FIG. 1B), and the same applies to the cross sections 18 at the second end of the rolling die 10 (see FIG. 1C). Furthermore, the centre lines of the depressions 18 are arranged so as to be straight, parallel to each other and equidistant from each other.

Figure 2A:
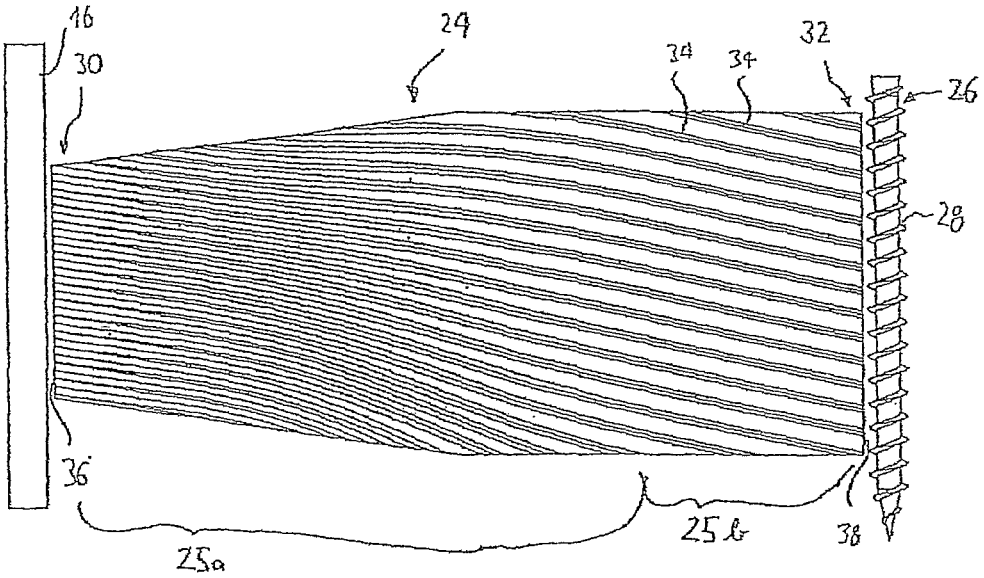
FIG. 2A shows a top view of a rolling die according to a first embodiment of the invention, as well as of a blank and of a finish-rolled thread.
Figure 2B:
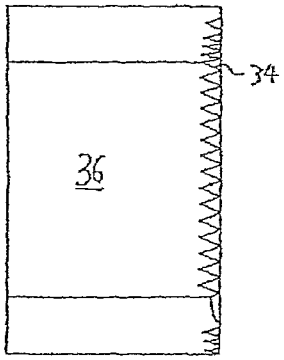
FIG. 2B shows a top view of an end face of the rolling die of FIG. 2A at its first end.
Figure 2C:
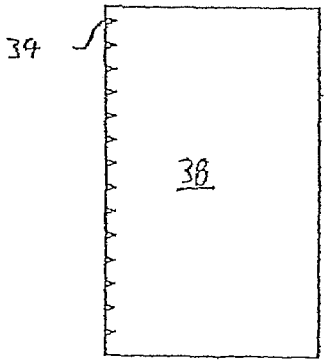
FIG. 2C shows a top view of an end face of the rolling die of FIG. 2A at its second end.
Figures 2D, 2E:
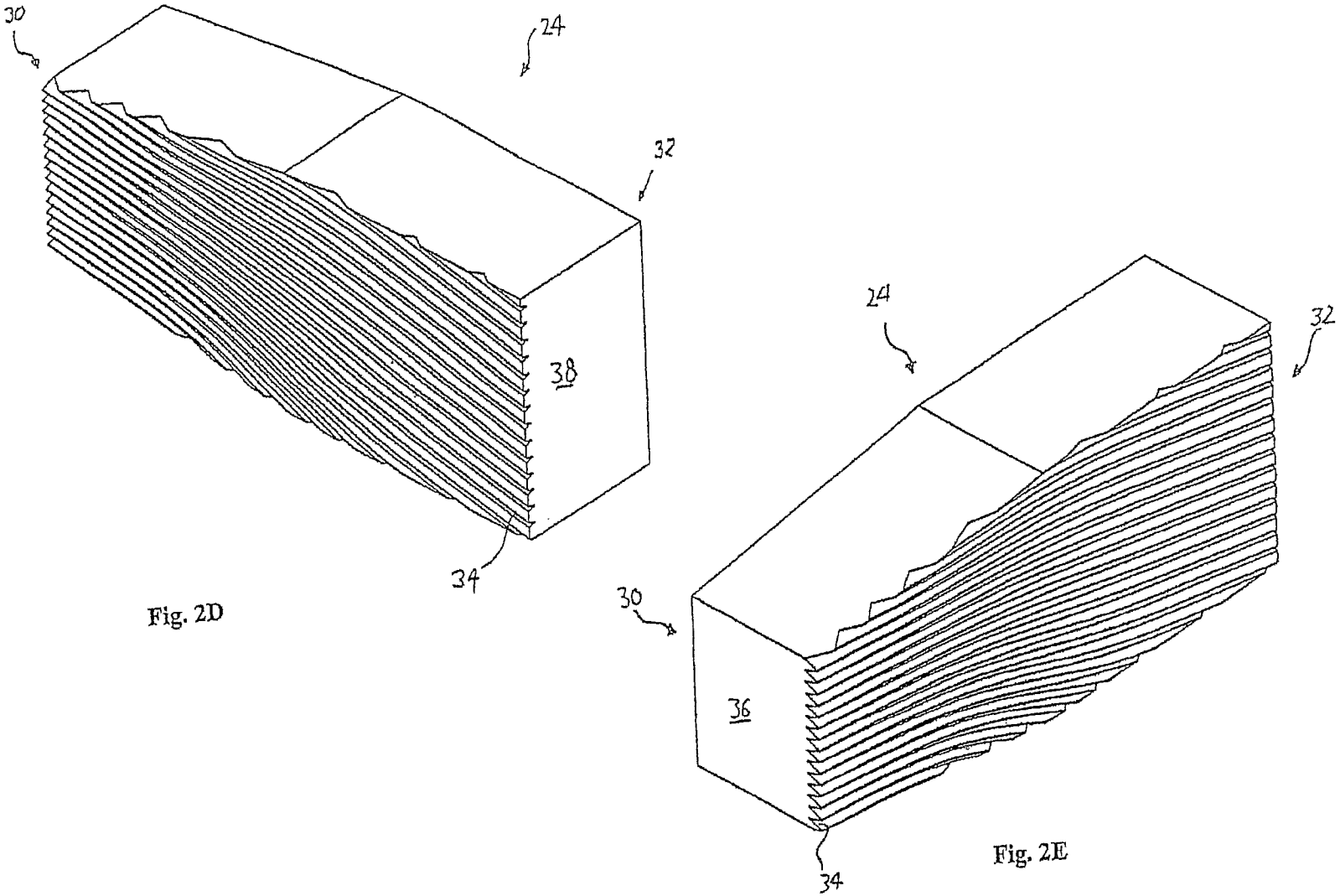
FIGS. 2D and 2E show perspective views of the rolling die of FIG. 2A.

FIG. 2A shows a top view of a rolling die 24 that is suitable for manufacturing a screw 26, which is also shown, with a continuous thread 28 with a constant thread pitch. The screw 26 can be made from a blank 16 that is identical to the one shown in the embodiment of FIG. 1A, which blank 16 is rolled from a first end 30 of the rolling die 24 towards a second end 32. FIGS. 2B and 2C show top views of end faces 36 or 38 in the region of the first or second end 30, 32 of the rolling die 24. FIGS. 2D and 2E show perspective views of the rolling die 24.

As shown in FIGS. 2A, 2D and 2E the rolling profile of the rolling die 24 comprises a multitude of elongated depressions 34, which however, in a manner that differs from that of the rolling die 10 of FIG. 1A, are not straight, parallel and equidistant along their entire length. Instead, the depressions in the region of the first end 30 of the rolling die 24 are spaced more closely together than in the region of the second end 32, and the slopes of the centre lines of the depressions, which are defined as the quotient of the changes in the position of the centre lines in the directions transverse and parallel to the direction of rolling, respectively, in the region of the first end of the rolling die are smaller than in the region of the second end. Between the first and the second ends 30, 32 of the rolling die the depressions 34 are formed in a suitable manner in order to establish a smooth transition between the smaller slope in the region of the first end 30 of the rolling die 24, and the larger slope in the region of the second end 32 of the rolling die 24.

It should be noted that in the embodiment shown the transition between the initial slope and the final slope essentially takes place in a first length region 25*a* of the rolling die, which length region 25*a* extends from the first end 30 to approximately ⅔ to ¾ of the total length. In a second length region 25*b* adjacent to the second end 32 of the rolling die 24, the depressions 34 are parallel and equidistant, and thus also comprise a constant slope in a manner that is similar to that of the conventional rolling die 10 of FIG. 1A. In the first length region 25*a* of the rolling die 24 the blank is thus stretched during forming of the thread, whereas in the remaining second length region 25*b*, i.e. at the end of the rolling path, the thread 28 is further formed only.

FIGS. 2A to 2E show that by means of the rolling die 24 according to the first embodiment a comparatively slender screw can be manufactured from a comparatively thick blank. In this arrangement the ratio of the cylindrical substitute diameter of the finished screw 26 to the blank 16 is approximately equal to the square root of the ratio of the slope of the depressions 34 at the first and the second ends 30, 32 of the rolling die 24. It is thus possible, for manufacturing a screw with the desired shape, to freely select the diameter of the blank within certain limits, and to correspondingly vary the slope of the depressions at the first end 30 of the rolling die 24 relative to the slope at the second end 32 of the rolling die 24.

It should be noted that in the diagrammatic illustration of FIG. 2A the screw 26 only shows the rolled thread section, while the non-rolled section of the blank has however, for the sake of simplicity, been left out. This non-rolled section of the comparatively thick blank can then be used, for example, for the pressing of a screw head, or in order to form a metric thread on said blank in a further rolling procedure, in order to produce a hanger screw (not shown in the figures).

In the embodiment of FIG. 2A the cylindrical substitute diameter of the screw relative to that of the blank was reduced in the rolling process, but the cylindrical substitute diameter of the finished thread, or the volume per unit of length, remained constant within the finished thread. However, in many applications it is advantageous to form the rolling profile so that the volume per unit of length in the finished thread is no longer constant. One application of this relates to screws with a continuous thread of variable thread pitch, in which more material is required for forming the thread in the region of a small thread pitch, i.e. a small slope. This is explained in more detail in a second embodiment of the invention. However, before this second embodiment is described, with reference to FIGS. 3A to 3D, the design of a rolling die for forming a variable thread pitch is explained, in which there is at first no appreciable volume transport in the axial direction. Starting from this geometry of the rolling profile, there follows a description as to how the desired axial volume transport can be accomplished.

FIG. 3A shows a top view of a rolling die 40 that is suitable for a method for manufacturing a screw 42, also shown, with a continuous thread 44 with a variable thread pitch. The screw 44 can be made from a blank 16 that is identical to the one shown in the embodiment of FIG. 1A, which blank 16 is rolled from a first end 46 of the rolling die 40 towards a second end 48. FIGS. 3B and 3C show top views of end faces 52 or 54 in the regions of the first and second ends 46, 48 of the rolling die 40, respectively.

Figure 3D:
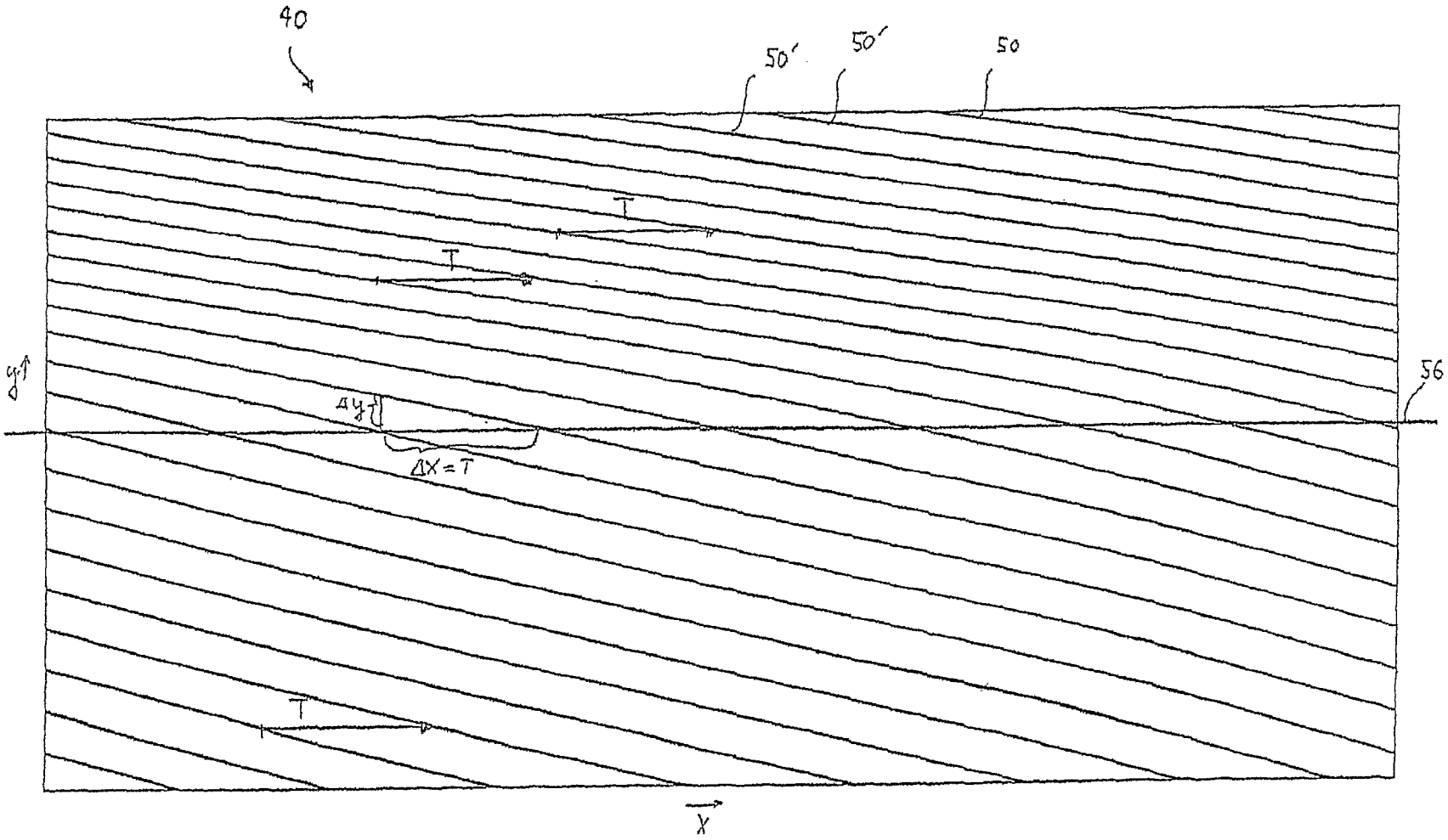
FIG. 3D shows an enlarged and simplified view of the top view of the rolling die of FIG. 3A.

As shown in FIG. 3A, the rolling profile of the rolling die 40 comprises a multitude of elongated depressions 50, which however, in a manner that differs from that of the rolling die 10 of FIG. 1A, are not straight, not parallel and not equidistant. The geometry of the depressions 50 is described in more detail with reference to FIG. 3D, which shows an enlarged top view of the rolling die 40 and which for the sake of clarity only shows the centre lines 50' of the respective elongated depressions 50.

As shown in FIG. 3D, in each case the centre lines 50' of two adjacent depressions 50 are designed and arranged in such a manner that they can be aligned as a result of a virtual shift in the direction of rolling by a constant distance T. The centre lines 50' have a slope that is defined as the quotient of the changes Δy and Δx of the position of the centre line in the direction transverse (y-direction) and parallel (x-direction) to the direction of rolling, respectively. Because of the translation symmetry in the direction of rolling, the slopes of each centre line at its intersection with a line 56 that is parallel to the direction of rolling are identical. Moreover, this slope is proportional to the thread slope or thread pitch in the section 58 of the finished screw 42 (see also FIG. 3A) corresponding to the line 56, i.e. the section of the screw that is formed by a section of the rolling die 40 that extends along the line 56.

FIGS. 3B and 3C show that the distances between adjacent depressions 50 in the y-direction, i.e. in a direction transverse to the direction of rolling, change both at the first and at the second ends 46, 48 of the rolling die 40. This change in spacing reflects the variable thread pitch, because the spacing denotes a "local" slope of the screw, in other words the local thread pitch of the screw. It should be noted that the local thread slope $P=dy/d\phi$ is proportional to the slope $\Delta y/\Delta x$ shown in FIG. 2D, because during rolling of the blank a certain distance Δx corresponds to a certain rolling angle Δφ.

However, it should be noted that the mean slope of the depressions 50 in—when viewed in the direction of rolling—opposite regions at the first and second ends 46, 48 of the rolling die 40 are identical in the present embodiment. For illustration, FIG. 3B shows a first region 60 of the first end and FIG. 3C shows a first region 62 of the second end of the rolling die 40. Each of these regions comprises six depressions 50, which means that the mean slope of the depressions 50 in the opposite regions 60, 62 is identical.

FIG. 3B further shows a second region 64 of the first end of the rolling die 40, with the width of said region 64 corresponding to the width of the first region 60, in which, however, the mean slope of the depressions is larger, because only four depressions fit into this region 64. The second region 64 of the first end is opposite a second region 66 of the second end, in which the mean slope is larger than in the first section 62 of the second end, but equal to the mean slope in the opposite section 64 of the first end.

The fact that the mean slopes in—when viewed in the direction of rolling—opposite sections 60/62 or 64/66 at the first and second ends 46, 48 of the rolling die 40 are identical results in there being practically no material volume transport in the axial direction of the blank (or the y-direction of the rolling die 40).

There is a further difference between the rolling die 40 of FIGS. 3A to 3D and the rolling die 10 of FIGS. 1A to 1C from the prior art, in that such depressions 50, whose centre lines in the region of the first end 46 of the rolling die 40 have a larger slope, are deeper in the region of the first end 46 than those whose centre line in the region of the first end 46 has a smaller slope, as is clearly shown in FIG. 3B. In contrast to this, in the rolling die 10 of FIG. 1B the depths of all depressions 18 at the first end 12 of the rolling die 10 are identical. By matching the milling depth of the depressions 50 in the region of the first end 46 of the rolling die 40 to the slope, i.e. to the distance between adjacent depressions 50, it can be ensured that peaks are formed between two adjacent depressions 50, which are all at least approximately on the same level and thus establish contact with the blank 16 at the same time. As shown in FIG. 3B, in the first embodiment the depressions 50 in the region of the first end 46 of the rolling die 40 are V-shaped in cross section, and their depth is proportional to the slope of the centre line 50' in the region of the first end 46 of the rolling die 40, or, in other words, to the distance between adjacent depressions 50.

Since the blank 16 that is used is cylindrical in shape and thus comprises a constant volume per unit of length, the screw 42 that has been manufactured with the rolling die 40 also has a constant volume per unit of length, because the geometry of the rolling profile of FIG. 3A has at first been selected in such a manner that a volume transport in the axial direction is avoided during rolling of the blank 16. However, in a region with a smaller thread pitch, in which region the windings are spaced more closely together, the finished screw 42 requires more material. If the thread pitch along the screw greatly varies, it can happen that during rolling the thread may not be fully "filled" in some locations, because insufficient material is present, i.e. the diameter of the thread is reduced in this region.

Hereinafter, the lack of material in the region of a smaller thread pitch is referred to as a "volume defect". This patent specification proposes three approaches for compensating for the volume defect.

A first solution provides for the use of a blank with a variable cross section, instead of a cylindrical blank. In regions in which a thread section with a small thread pitch is to be formed, the proposed blank comprises a somewhat larger diameter than in regions in which a section with a comparatively large thread pitch is to be formed. However, this solution is less advantageous in that it requires expensive manufacture of the blank.

A second solution provides for varying the cross sectional area of a thread ridge by varying the flank angle and/or the thread depth of the thread 44 in such a manner that in a region with a smaller thread pitch the finish-rolled thread comprises a smaller cross-sectional area of the thread ridge, and in this way the volume defect is compensated for. The thread can thus have a more acute flank angle so that the thread, when viewed in longitudinal section of the screw, is narrower and comprises a more acute flank, thus using less material. In the rolling die 40 this can easily be implemented in that the widths of the depressions 50 at the second end 48 of the rolling die 40 are formed so as to be narrower and/or less deep in regions with a smaller thread pitch.

The third and preferred solution provides for the rolling profile to be designed in such a manner that a certain targeted volume transport from regions with a larger thread pitch into regions with a smaller thread pitch is generated, which volume transport just compensates for the volume defect. This third variant is described in the second embodiment, which hereinafter is described with reference to FIGS. 4A to 4C.

FIG. 4A shows a top view of a rolling die 68 according to a second embodiment of the present invention, which rolling die 68 comprises a first end 70 and a second end 72. In a manner similar to that shown in FIG. 3A, the rolling die 68 has a rolling profile comprising a multitude of elongated, curved, non-parallel depressions 74. The course of the depressions 74 is based on the one shown in FIG. 3A, which course has, however, in addition been modified with a view to a special intended volume transport.

FIGS. 4B and 4C in turn show the top view of the end surfaces 76 or 78 of the first and second ends 70, 72 of the rolling die 68, respectively. As is shown by a comparison of FIG. 3C with FIG. 4C, in the second embodiment the rolling profile at the second end 72 of the rolling die 68 is identical to that at the second end 48 of the rolling die 40 of FIGS. 3A to 3D. This is due to the fact that the rolling process is completed at the second end, and that in this process, apart from the correction of the volume defect, with both embodiments the same screw type is to be manufactured. The difference between the first embodiment and the second embodiment consists of the shape of the rolling profile at the first end of the rolling die 68, as is shown by a comparison of FIG. 4B with FIG. 3B.

According to the second embodiment of FIGS. 4B and 4C the thread slopes in—when viewed in the direction of rolling—opposite sections of the first and second ends 70, 72 of the rolling die 68 are no longer identical. FIG. 4B shows a first region 80 of the first end 70 of the rolling die 68, which region 80 comprises five depressions 74. This region is opposed—when viewed in the direction of rolling—at the second end 72 of the rolling die 68 by a region 82 that comprises six depressions 74. In other words the mean slope $P_{11}$ in the first region 80 of the first end 70 is larger than the mean slope $P_{21}$ in the first region 82 of the second end 72. As a result of this, during rolling of the blank 16 an axial material transport to the section of the thread corresponding to region 82 takes place. Since the thread section that corresponds to region 82 is a section with a small thread pitch, in this manner the volume defect described above can be compensated for in this region.

The opposite effect occurs in a second region 86 at the second end 72 of the rolling die 52, which region 86 is opposite a second region 84 at the first end 70 of the rolling die 68—when viewed in the direction of rolling. As FIGS. 4B and 4C show, the mean slope $P_{22}$ of the second region 86 at the second end of the rolling die 68 is larger than the mean slope $P_{12}$ at the—when viewed in the direction of rolling—opposite region 84, which means that material transport out of the section of the thread corresponding to region 86 takes place. This is expedient, because the corresponding region of the thread is a region with a high thread pitch where therefore less material per unit of length is needed for forming the thread.

It should be noted that by means of a variation in the thread pitch in—when viewed in the direction of rolling—opposite sections at the first and second ends of the rolling die, both a global elongation or contraction of the thread and a redistribution of material in the axial direction can be achieved. However, for correcting the volume defect described above, global elongation or contraction is not sufficient; instead, material from a region with a larger thread pitch must be transferred to a region with a smaller thread pitch. A criterion for such redistribution is provided by the following inequation:

$$P_{21}/P_{11}<P_{22}/P_{12},$$

wherein $P_{21}$ denotes the mean slope of the depressions in a first region at the second end of the rolling die, $P_{22}$ denotes the mean slope of the depressions in a second region at the second end of the rolling die, and $P_{11}$ and $P_{12}$ denote the mean slopes in the regions at the first end of the rolling die which are opposite—when viewed in the direction of rolling—said first and the second regions, respectively, and wherein, furthermore, $P_{21}<P_{22}$ applies. The above inequation thus defines a local redistribution of material in the axial direction which goes beyond a global elongation or contraction.

The rolling die of FIGS. 4A to 4C can, for example, be constructed as follows: the rolling die without volume transport, as shown in FIG. 3A, can be the starting point. The geometry of the depressions of the rolling die without volume transport can then be constructed, starting from a desired form of the finished screw and using the criteria mentioned in connection with FIGS. 3A to 3E. As explained above, the mean slopes in—when viewed in the direction of rolling—opposite sections at the first and second ends of the rolling die are at first identical. In a second step the pitch dimensions at the first end can then be varied in such a manner that the desired volume transport results. To this effect, preferably, a correction value dp(i) is added to the slope of the i-th depression at the first end, which correction value is calculated as follows:

$$dp(i) = \frac{\Delta V(i)}{d_{G0}^2 \pi / 4},$$

where ΔV denotes the volume defect of the i-th winding and $d_{G0}$ denotes a "cylindrical substitute diameter" of the finished thread, i.e. the diameter of a substitute cylinder that has the same length and the same volume as the finished thread. In this arrangement dp(i) denotes the change in pitch Δϕ which is proportional to a change ΔX in the depressions in the direction of rolling.

In this manner the slope corrections at the first end can be calculated in respect of each winding. The correction results in a shift of the depressions at the first end of the rolling die, as is evident by a comparison of FIG. 4B with FIG. 4C. The individual depressions can then be modified by smooth functions in such a manner that they result in the desired variation at the first end of the rolling die and the desired thread form at the second end of the rolling die.

It should be noted that in the rolling dies 24, 40 and 68 of FIG. 2, FIG. 3 or FIG. 4 the slopes of the centre lines of the depressions change continuously. In other words this means that the depressions are not kinked at any point, which would correspond to a sudden change in the thread pitch. Such sudden changes would, for example, result if the finished screw were to comprise a series of thread sections with different thread pitches that are, however, constant within the section. A corresponding rolling die may possibly be easier to construct but more involved to manufacture than the rolling dies disclosed in this document. The rolling dies shown in this document having smooth depressions without any kinks can be made with the use of milling methods. This is not possible without further ado for rolling dies with kinked depressions. While it would be possible to compose the rolling die at the kinked positions from several separately-manufactured components, the inventor has, however, recognized that such a composite rolling die has a tendency to be prone to excessive wear. As an alternative it would be possible to manufacture a rolling die with kinked depressions in an erosion method, which is, however, significantly more expensive than a milling method. For this reason, the rolling die with a smooth kink-free course of the depressions has been shown to be particularly advantageous.

LIST OF REFERENCE CHARACTERS

10 rolling die
12 first end of the rolling die 10
14 second end of the rolling die 10
16 blank
18 depression
19 screw
20 end face at the first end of the rolling die 10
22 end face at the second end of the rolling die 10
24 rolling die
25*a* first length region
25*b* second length region
26 screws
28 thread
30 first end of the rolling die 24
32 second end of the rolling die 24

34 depression
36 end face at the first end of the rolling die 24
38 end face at the second end of the rolling die 24
40 rolling die
42 screw
44 thread of the screw 42
46 first end of the rolling die 40
48 second end of the rolling die 40
50 depression
52 end face at the first end of the rolling die 40
54 end face at the second end of the rolling die 40
56 line parallel to the direction of rolling
58 section of the thread 42
60 first region at the first end of the rolling die
62 first region at the second end of the rolling die 40
64 second region at the first end of the rolling die 40
66 second region at the second end of the rolling die 40
68 rolling die
70 first end of the rolling die 68
72 second end of the rolling die 68
74 depression
76 end face at the first end of the rolling die 68
78 end face at the second end of the rolling die 68
80 first region at the first end of the rolling die 68
82 first region at the second end of the rolling die 68
84 second region at the first end of the rolling die 68
86 second region at the second end of the rolling die 68

I claim:

1. A method for manufacturing a screw, comprising the steps of:

providing two rolling dies, wherein on each rolling die a rolling profile is formed that comprises a plurality of elongated depressions, and wherein each rolling die comprises a first and a second end spaced apart from each other in the direction of rolling; and rolling a blank between the two rolling dies such that the blank is moved relative to each die from the first end towards the second end, respectively, and wherein for at least one of the rolling dies a mean slope of the center lines of the depressions in a region of the first end of the at least one rolling die differs from a mean slope of the center lines of the depressions in a region of the second end of the at least one rolling die, wherein the region of the second end of the at least one rolling die is opposite the region of the first end of the at least one rolling die, and wherein the slope of a center line is defined as the quotient of the changes in the positions of the center line in the directions transverse and parallel to the direction of rolling, respectively.

2. The method according to claim 1, wherein the mean slopes in the regions at the first end and at the second end differ from each other by at least 2.5%.

3. The method according to claim 1, wherein the mean slopes in the regions at the first end and at the second end differ from each other by at least 10%.

4. The method according to claim 1, wherein the mean slopes in the regions at the first end and at the second end differ from each other by at least 25%.

5. The method according to claim 1, wherein the mean slope in the region of the second end is larger than the mean slope in the region of the first end.

6. The method according to claim 1, wherein the rolling profile creates a mean volume per unit of length of the finish-rolled screw thread which is smaller by at least 5% than that of the blank.

7. The method according to claim 1, wherein the rolling profile creates a mean volume per unit of length of the finish-rolled screw thread which is smaller by at least 17% than that of the blank.

8. The method according to claim 1, wherein the rolling profile creates a mean volume per unit of length of the finish-rolled screw thread which is smaller by at least 27% than that of the blank.

9. The method according to claim 1, wherein the blank is cylindrical in form and wherein, after the blank is rolled between the two rolling dies to form the screw, a thread section of the screw has a volume per unit length ratio which varies along the length of the screw.

10. The method according to claim 9, wherein the difference between a maximum value and a minimum value of the volume per unit of length of the thread section is at least 2% of the maximum value of the volume per unit of length.

11. The method according to claim 9, wherein the difference between a maximum value and a minimum value of the volume per unit of length of the thread section is at least 4% of the maximum value of the volume per unit of length.

12. The method according to claim 9, wherein the difference between a maximum value and a minimum value of the volume per unit of length of the thread section is at least 6% of the maximum value of the volume per unit of length.

13. The method according to claim 9, wherein the screw has a continuous thread with a variable thread pitch, and the mean slope $P_{21}$ of the depressions in a first region at the second end of one of the rolling dies is less than the mean slope $P_{22}$ of the depressions in a second region at the second end of said rolling die, and wherein the following applies:

$$P_{21}/P_{11}<P_{22}/P_{12}$$

wherein $P_{11}$ and $P_{12}$ denote the mean slope in a first and a second region, respectively, at the first end of said rolling die, which when viewed in the direction of rolling, are opposite the first and second regions of the second end, respectively.

14. The method according to claim 13, wherein the depressions in a region of the second end are formed in such a manner that a finish-rolled thread in a region of a smaller thread pitch has one or both of a smaller cross-sectional area and a more acute flank angle of a thread ridge than in a region of the finish-rolled thread having a larger thread pitch.

15. The method according to claim 14, wherein the depressions in a third region at the second end of the rolling die where a mean thread pitch is smaller than in a fourth region at the second end of the rolling die, are narrower than in the fourth region.

16. The method according to claim 13, wherein a depression in a third region of the first end has depth $D_1$ and has a center line with slope $S_1$, and wherein a depression in a fourth region of the first end has depth $D_2$ and has a center line with slope $S_2$, and wherein $D_1>D_2$ and $S_1>S_2$.

17. The method according to claim 16, wherein the depression in a region of the first end of the rolling die is V-shaped in cross section, and its depth is proportional, at least within ±10%, to the slope of the center line.

18. The method according to claim 1, including the step of forming a screw head by pressing a non-threaded section of the screw.

19. The method according to claim 1, wherein the screw comprises two threads that are separate of each other, and at least one of the threads is rolled in a method according to claim 1.

20. The method according to claim 19, wherein the screw is a hanger screw that comprises a metric thread and a wood thread or dowel thread.

21. The method according to claim 1, wherein the slopes of the center lines of the depressions vary continuously.

22. A rolling die for manufacturing a screw, comprising:

said rolling die having a rolling profile that comprises a plurality of elongated depressions, and wherein said rolling die comprises a first and a second end spaced apart from each other in the direction of rolling such that during rolling the blank is moved relative to the die from the first end towards the second end, and wherein a mean slope of the center lines of the depressions in a region of the first end of the rolling die differs from a mean slope of the center lines of the depressions in a region of the second end of the rolling die, wherein the region of the second end of the rolling die is opposite the region of the first end of the rolling die, and wherein the slope of a center line is defined as the quotient of the changes in the positions of the center line in the directions transverse and parallel to the direction of rolling, respectively.

23. The rolling die according to claim 22, wherein the mean slope in the regions at the first end and at the second end differ from each other by at least 2.5%.

24. The rolling die according to claim 22, wherein the mean slope in the regions at the first end and at the second end differ from each other by at least 15%.

25. The rolling die according to claim 22, wherein the mean slope in the regions at the first end and at the second end differ from each other by at least 25%.

26. The rolling die according to claim 22, wherein the mean slope in the region of the second end is larger than the mean slope in the region of the first end.

27. The rolling die according to claim 22, wherein the rolling profile creates a mean volume per unit of length of the finish-rolled screw thread which is smaller by at least 5% than that of the blank.

28. The rolling die according to claim 22, wherein the rolling profile creates a mean volume per unit of length of the finish-rolled screw thread which is smaller by at least 17% than that of the blank.

29. The rolling die according to claim 22, wherein the rolling profile creates a mean volume per unit of length of the finish-rolled screw thread which is smaller by at least 27% than that of the blank.

30. The rolling die according to claim 22, wherein for a cylindrical blank that is rolled along the rolling die to form a screw, the screw has a thread section which has a volume per unit length ratio which varies along the length of the screw.

31. The rolling die according to claim 30, wherein a difference between a maximum value and a minimum value of the volume per unit of length of the thread section is at least 2% of the maximum value of the volume per unit of length.

32. The rolling die according to claim 30, wherein the difference between a maximum value and a minimum value of the volume per unit of length of the thread section is at least 4% of the maximum value of the volume per unit of length.

33. The rolling die according to claim 30, wherein the difference between a maximum value and a minimum value of the volume per unit of length of the thread section is at least 6% of the maximum value of the volume per unit of length.

34. The rolling die according to claim 30, wherein the screw has a continuous thread with a variable thread pitch, and the mean slope $P_{21}$ of the depressions in a first region at the second end of the rolling die is less than the mean slope $P_{22}$ of the depressions in a second region at the second end of the rolling die, and wherein the following applies:

$$P_{21}/P_{11}<P_{22}/P_{12}$$

wherein $P_{11}$ and $P_{12}$ denote the mean slope in a first and a second region, respectively, at the first end of the rolling die, which when viewed in the direction of rolling, are opposite the first and second regions of the second end, respectively.

35. The rolling die according to claim 34, wherein the depressions in the region of the second end are formed in such a manner that a finish-rolled thread in a region of a smaller thread pitch has one or both of a smaller cross-sectional area and a more acute flank angle of a thread ridge than in a region of a larger thread pitch.

36. The rolling die according to claim 35, wherein the depressions in a first region at the second end of the rolling die where a mean thread pitch is smaller than in a second region at the second end of the rolling die, are narrower than in the second region.

37. The rolling die according to claim 34, wherein a depression in a first region of the first end has depth $D_1$ and has a center line with slope $S_1$, and wherein a depression in a second region of the first end has depth $D_2$ and has a center line with slope $S_2$, and wherein $D_1>D_2$ and $S_1>S_2$.

38. The rolling die according to claim 37, wherein the depressions in the region of the first end of the rolling die are V-shaped in cross section, and the depth of the depressions is proportional, at least within ±10%, to the slope of the center line.

39. The rolling die according to claim 22, wherein the slopes of the center lines of the depressions vary continuously.

* * * * *